US006213167B1

(12) United States Patent
Greenland

(10) Patent No.: US 6,213,167 B1
(45) Date of Patent: Apr. 10, 2001

(54) INFLATABLE PACKAGE CUSHIONING AND METHOD OF USING SAME

(76) Inventor: Steven J. Greenland, 1909 Windy Oaks Rd., Hixson, TN (US) 37343

( * ) Notice: Subject to any disclaimer, the term of this patent is extended or adjusted under 35 U.S.C. 154(b) by 0 days.

(21) Appl. No.: 09/384,868

(22) Filed: Aug. 27, 1999

Related U.S. Application Data

(62) Division of application No. 09/057,297, filed on Apr. 8, 1998, now Pat. No. 6,015,047.

(51) Int. Cl.[7] ..... B65B 1/04; B65B 3/04

(52) U.S. Cl. ..... 141/10; 141/1; 141/67; 141/114; 141/313; 141/237; 53/385.1; 53/570; 156/145; 156/147

(58) Field of Search ..... 141/10, 67, 68, 141/70, 131, 132, 134, 164, 166, 177, 234, 236, 237, 242, 244, 246, 114, 1, 313–317, 98, 325, 329, 330; 53/385.1, 570; 156/145, 147, 292, 494, 497, 498

(56) References Cited

U.S. PATENT DOCUMENTS

| | | | | |
|---|---|---|---|---|
| 3,207,420 | | 9/1965 | Navarette-Kindelan | 229/56 |
| 3,389,534 | | 6/1968 | Pendleton | 53/180 |
| 3,865,667 | * | 2/1975 | Ferrari | 156/285 |
| 4,169,002 | * | 9/1979 | Larson | 156/145 |
| 4,835,037 | | 5/1989 | Beer | 428/35.2 |
| 4,877,339 | | 10/1989 | Cope | 383/3 |
| 4,918,904 | | 4/1990 | Pharo | 53/472 |
| 5,180,060 | | 1/1993 | Forti et al. | 206/522 |
| 5,254,074 | | 10/1993 | Landers et al. | 493/213 |
| 5,261,466 | * | 11/1993 | Koyanagi | 141/10 |
| 5,339,602 | | 8/1994 | Landers et al. | 53/410 |
| 5,351,828 | | 10/1994 | Becker et al. | 206/522 |
| 5,469,966 | | 11/1995 | Boyer | 206/522 |
| 5,552,003 | | 9/1996 | Hoover et al. | 156/147 |

* cited by examiner

*Primary Examiner*—Timothy L. Maust
(74) *Attorney, Agent, or Firm*—Hardaway/Mann IP Group

(57) ABSTRACT

An inflatable cushioning system with separate inflatable cushioning chambers a common tool guideway and a common air inlet. The inflatable cushioning chambers each have an inflation port. The common air inlet is in fluid communication with each of the inflatable cushioning chambers. During inflation, pressurized air is inserted into the common air inlet. The pressurized air then enters the individual cushioning chambers through the inflation ports. The inflatable cushioning system is inflated using a multi-purpose inflation tool having a body with a main portion and a second portion, the second portion being connected to the main portion and both portions having hollow interiors. The second portion of the tool having a connecting means for connecting the tool to an external pressurized air source. The tool also having a blade connected to said main portion for cutting the tool guideway as the tool is advanced through the tool guideway. The tool also has a plurality of apertures in the main portion for providing fluid into the inflatable cushioning system.

11 Claims, 9 Drawing Sheets

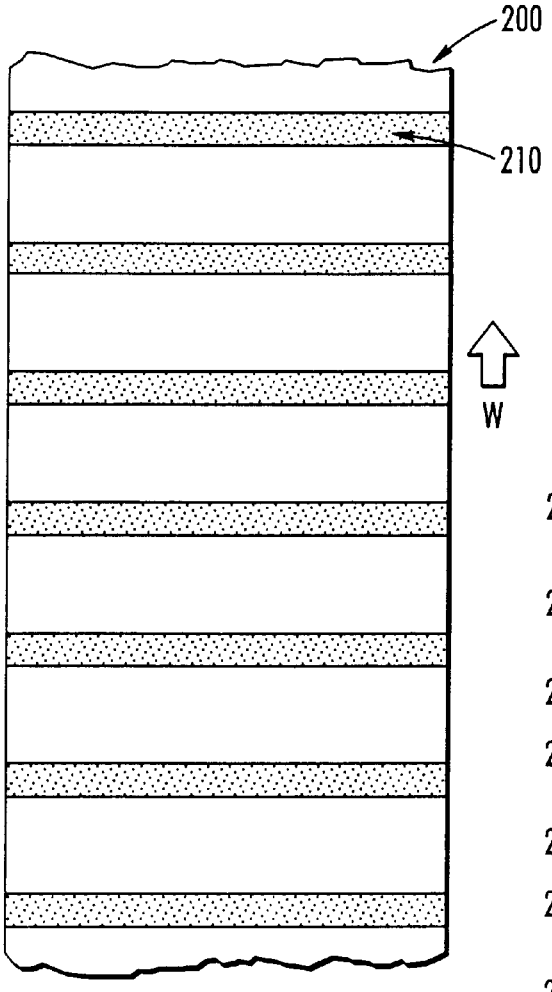
FIG. 7
FIG. 8
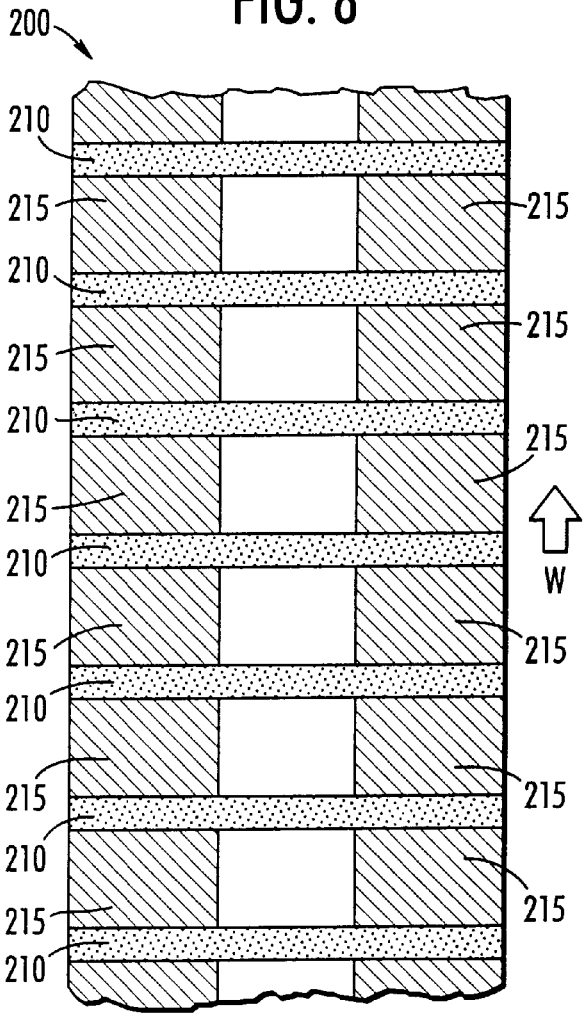

INFLATABLE PACKAGE CUSHIONING AND METHOD OF USING SAME

CROSS REFERENCE TO RELATED APPLICATIONS

This application is a divisional application of application Ser. No. 09/057,297, filed Apr. 8, 1998, now U.S. Pat. No. 6,015,047.

BACKGROUND OF THE INVENTION

The present invention relates to inflatable products. More particularly, the present invention relates to an inflatable device for packaging that has been specially provisioned to provide for rapid and simplified deployment.

The need for protecting products from damage during distribution has lead to the development of various shock absorbing packaging materials. These materials are intended to "float" a product within a shipping container and provide controlled deceleration to a packaged item during impact. Because of their low density, the transportation and storage cost of ready to use cushioning materials is significant. By utilizing "foam in place" or inflatable cushioning, the user may greatly reduce such costs.

The use of foamed polymer cushioning materials has many disadvantages. In order to use these "foam in place" materials a user must undertake the storage and mixing reactive chemicals that are hazardous in nature. Further to these problems, foamed cushioning materials are not readily recyclable or efficiently disposable by the recipient. Inflatable cushioning systems may offer solutions to many of these problems.

Inflatable cushioning systems use inert polymer films and do not require the handling of hazardous materials by the user. The various polymer films used in inflatable cushioning systems do not take up as much landfill space since the material is easily compacted after use by deflating the inflatable chambers, such as by cutting open the chambers. Inflatable cushioning systems may even require less storage space than the various components required for the use of foamed cushioning materials.

Example of inflatable cushioning systems and methods can be found in U.S. Pat. Nos. 5,254,074 and 5,339,602. In these devices, thermoplastic films are formed into a bag into which air is inserted. This inserted and entrapped air increases the volume of the bag so that the bag can fill the void between any fragile items and the carton or package in which the fragile item is being shipped. Typically, the bag will not be filled to its maximum capacity with air. Accordingly, the bag may be compressed between the packaging carton and the fragile item so as to block and brace the item within the container and better protect the item from breakage. While effective in achieving this end, the bag may provide only limited protection from deceleration forces that can damage the packaged item.

A further example of an inflatable cushioning system is described in U.S. Pat. No. 4,918,904 to Pharco. While providing improved deceleration characteristics that protect the item from shock, the cushioning system must be properly sized to the item to be packaged.

Presently available inflatable cushioning systems utilize a single or limited number of air receiving chambers. The systems will fail to provide any protection should an air leak occur. Further, present inflatable cushioning systems fail to provide means for rapid multiple deployment through automated or semi-automated processes.

SUMMARY OF THE INVENTION

Thus, it is an object of the present invention to provide an improved inflatable cushioning system.

It is a further object of the present invention to provide an inflatable cushioning system that provides for the use of a plurality of fluid receiving chambers.

It is a further object of the present invention to provide an inflatable cushioning system that provides for an automated or semi-automated deployment process.

It is a further object of the present invention to provide an inflatable cushioning system that can provide improved deceleration characteristics.

It is a further object of the present invention to provide an inflatable cushioning system that is adaptable to various sizes of shipping containers.

It is a further object of the present invention to provide an inflatable cushioning system having reduced risk of catastrophic failure.

These and other objects of the invention are achieved by an inflatable cushioning system having a plurality of independently maintained inflatable cushioning chambers. The inflatable chambers each have an integral one way inflation valve and corresponding inflation port. The outer terminus of the individual inflation ports are arranged along the interior wall of a common guideway. The guideway directs a specially designed inflation tool to the individual inflation ports. The guideway also yokes or otherwise couples the inflation tool to the inflation ports while the tool delivers fluid to the ports.

BRIEF DESCRIPTION OF THE DRAWINGS

The features of the present invention will become apparent to those skilled in the art to which the present invention relates from a reading of the following specification with reference to the accompanying drawings in which:

FIG. 7 is a top plan view of a step in the valve assembly manufacture;

FIG. 8 is a top plan view of another step in the valve assembly manufacture;

DETAILED DESCRIPTION OF THE PREFERRED EMBODIMENT

Inflatable cushioning systems are in many ways superior to their foamed agent counterparts. Inflatable cushioning systems have gained only limited industry acceptance because several problems remain. One problem is the reliability of the inflatable cushioning system. Current inflatable cushioning systems use a singular or limited number of cushioning chambers. If a chamber fails during transit, the packaged article loses most of its protection.

Another problem is the adjustability of current inflatable cushioning systems to varied packaged article sizes. Presently, users are compelled to inventory many different sizes of an inflatable cushioning system in order to meet all potential product applications and shipping carton sizes. The initial inventory and cost of maintaining may be considerable.

Another problem is the manual labor required to inflate currently available cushioning systems. Individual air cushioning chambers must be inflated one at a time. Automation has not been satisfactorily implemented.

With reference to the drawings, an inflatable cushioning chamber system and method for implementing and manufacturing the same that achieves the objects of the invention set forth above is described. The novel inflatable cushioning system and method for implementing and manufacturing same improves upon the above-mentioned problems. Accordingly, the present invention should be highly acceptable and advantageous to shippers and packers of all sizes. The novelty method of deploying the inflatable chambers is also applicable to other inflatable products, such as, but not limited to, greeting balloons.

Figure 1:
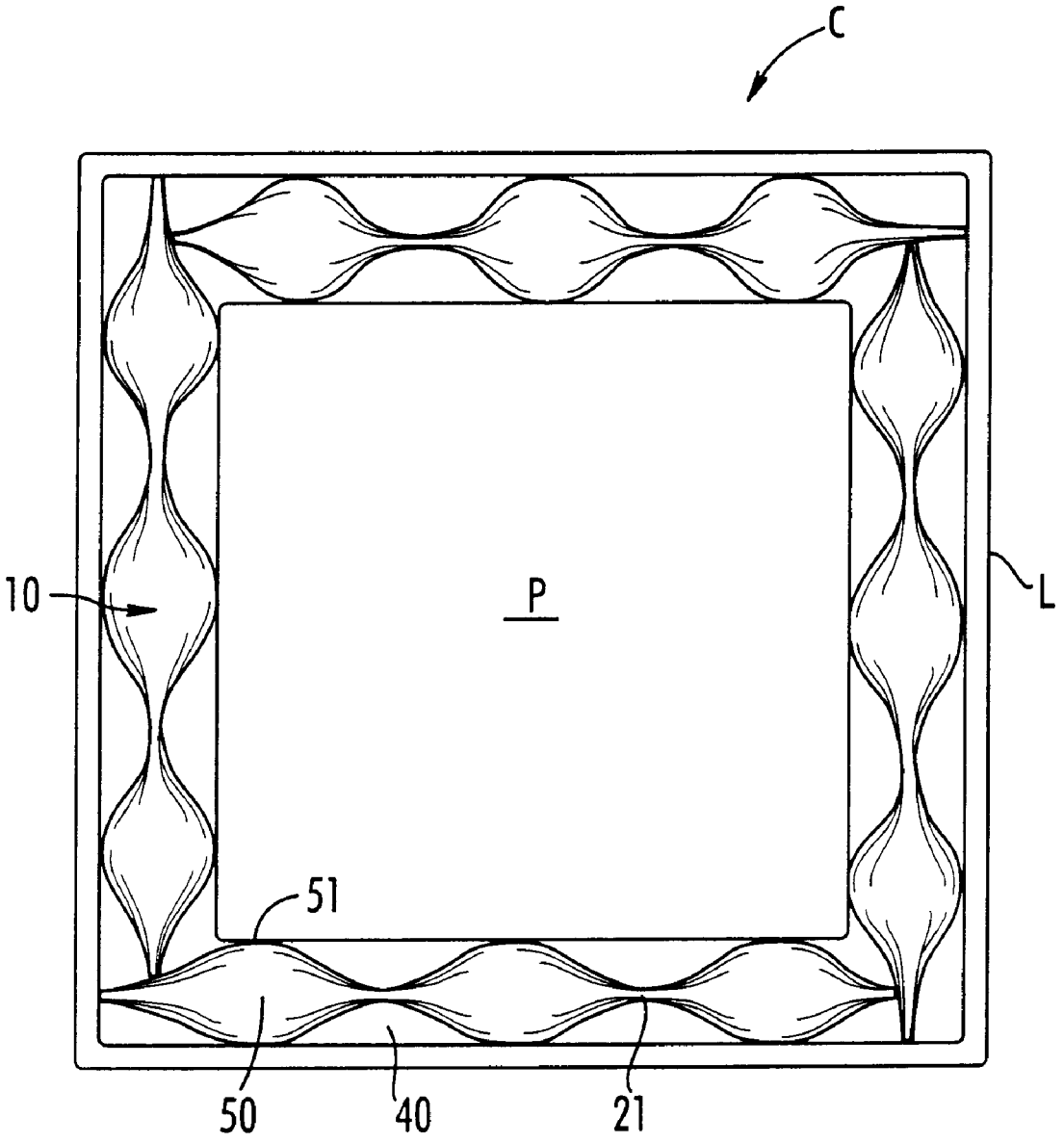
FIG. 1 is a top plan of the present invention positioned between a container wall and a packaged item.

FIG. 1 demonstrates the present invention use. The benefits, advantages, and objects of the invention are primarily achieved by providing a means of effectively deploying an inflatable cushioning system 10 with a plurality of inflatable air cushioning chambers 50. Air cushioning members 50 support packaged article P at apex 51. Inflatable cushioning system 10 is inserted between walls L of container C and packaged article P. Chambers 50 can physically deform to absorb transportation shock loads in two ways. The chambers 50 will distort as increased force compresses the gas contained in the chambers. The chambers 50 may also distort and absorb energy by elastic elongation of the material in the chamber walls. The chamber 50 of the current invention provides controlled deceleration characteristics that reduce possible damage to packaged article P during transit. The inflatable cushioning system 10 also exhibits excellent vibration dampening characteristics due to the independent action of each of the chambers.

The use of more than one inflatable cushioning chamber 50 provides increased protection to packaged article P. If one inflatable cushioning chamber 50 fails, the remaining inflated cushioning chambers 50 can continue to support and cushion packaged article P.

Furthermore, the present invention allows selective adjustment of inflatable cushioning system 10 to accommodate packaged article P of varying sizes. Inflatable cushioning system 10 spaces individual inflatable air cushioning chambers 50 at a fixed, predetermined distance along a continuous web of material. In this configuration, it is possible to separate any number of individual inflatable air cushioning chambers 50 in order to form a larger overall inflatable air cushion of almost any size.

Figure 3:
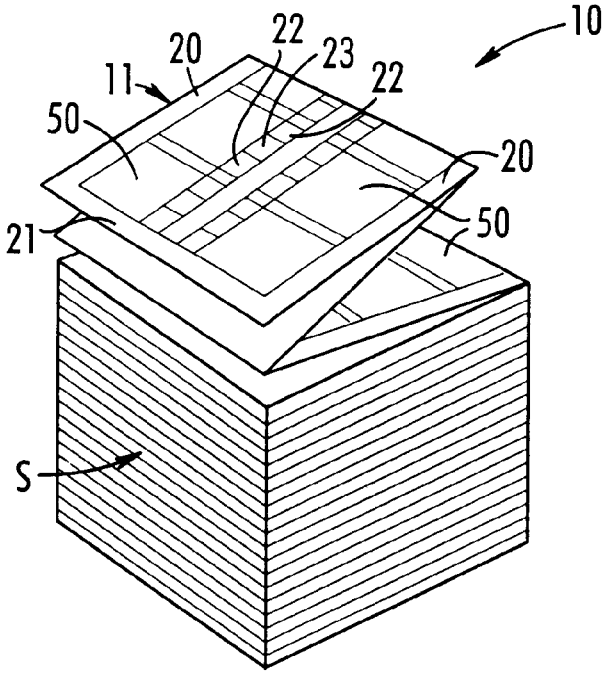
FIG. 3 is a perspective view of a second embodiment of a cushioning system according to the present invention.
Figure 4:
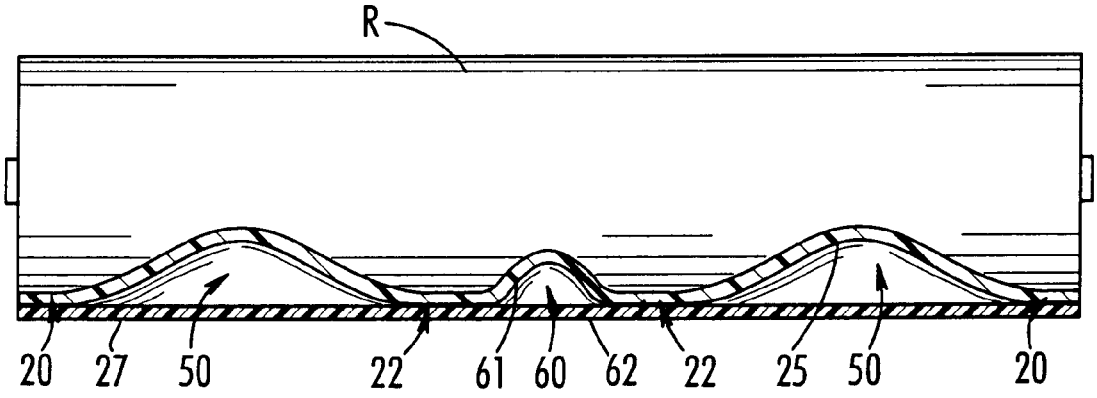
FIG. 4 is a cross-section view along line 2—2 of FIG. 2.

Finally, by the use of a special tool, it is possible to increase the rate at which individual inflatable air cushions may be inflated. FIGS. 3 and 4 demonstrate two embodiments of the tool.

Figure 2:
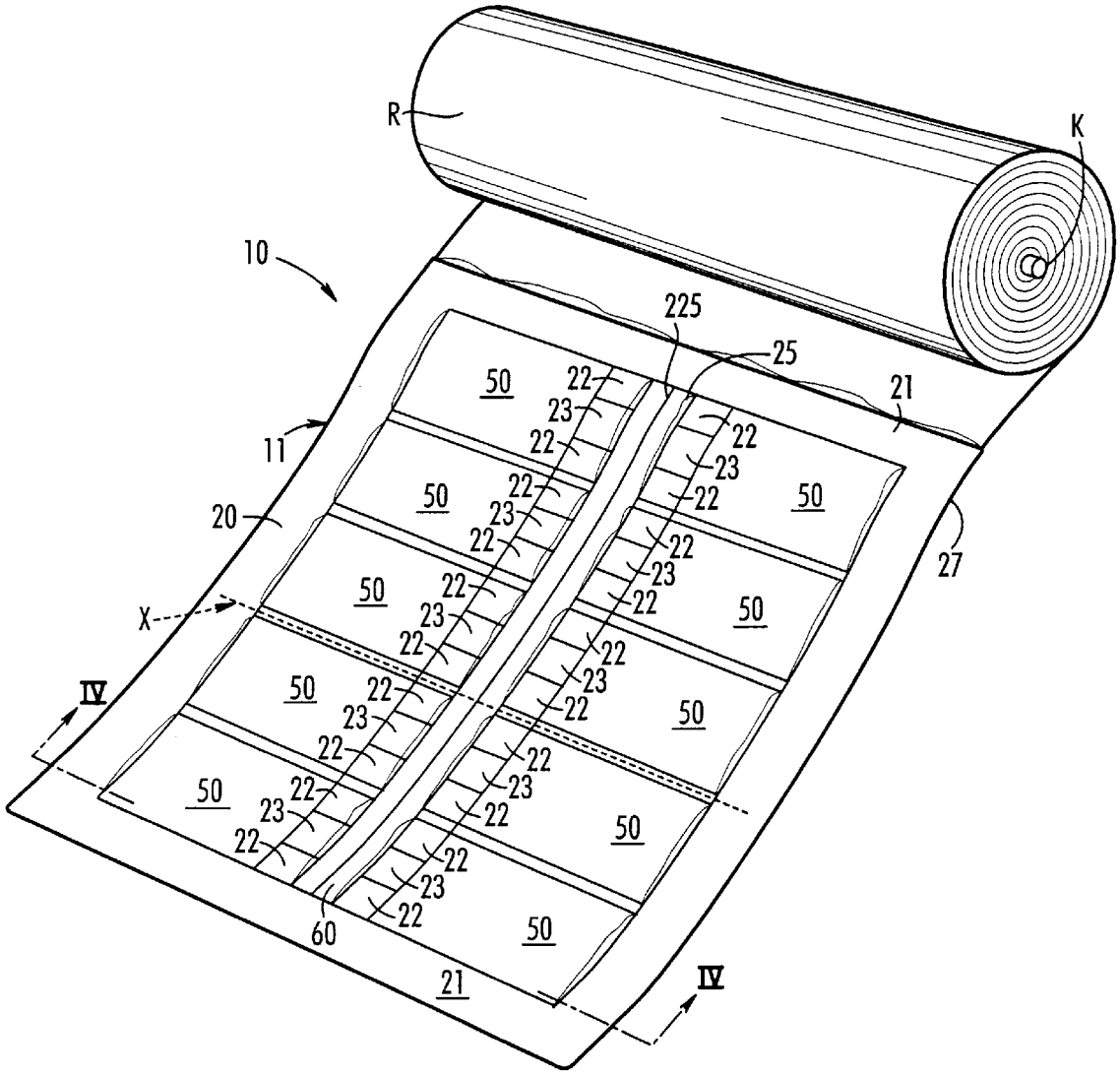
FIG. 2 is a perspective view of a first embodiment of a cushioning system according to the present invention.

Inflatable cushioning system 10 will now be described with reference to FIGS. 2–4. FIGS. 2 and 3 show two examples of air cushioning system 10 according to the present invention. FIG. 2 depicts cushioning system 10 stored as roll R of individual inflatable air cushioning chambers 50 wrapped around a conventional core K. FIG. 3 depicts cushioning system 10 stored as a stack S of continuous individual inflatable air cushioning chambers fan folded one on top of the other in a zig-zag like configuration.

FIGS. 2 and 4 show an unrolled portion 11 of cushioning system 10. FIG. 4 could equally depict portion 11 of FIG. 3, except stack S would replace roll R. Portion 11 generally comprises first and second layers or walls 25, 27 of thermoplastic film sealed together, such as by heat, thermal impulse or ultrasonic sealing. Primary seals 20 run parallel to web direction W. Secondary seals 21 run perpendicular to web direction W and may have perforations X on center to allow for the separation of a selected number of individual inflatable cushioning chambers 50 from the rest of cushioning system 10. The separation of a section of individual cushioning chambers from cushioning system 10 is most preferably made following the inflation of the chambers using multipurpose tool 100. Applicant also contemplates various size cushioning chambers 50 for customized application of the deployment method below described. Secondary seals 21 are formed, for example by heat, thermal impulse or ultrasonic sealing.

One way valve passages 23 are formed between secondary seals 21. One way valve passages 23 are formed during manufacture of valve assembly 240 discussed below. As shown in FIG. 2, secondary seals 21 run the entire length of the material from seal 20 to form a seal 22 and intersect with both. Seals 22 may be adhesive, thermal, or combination thereof. Seals 22 define one side of chambers 50, as well as the interior dimension of common inflation tool guideway 60. The combination of the seals 20, 21, and 22, and valves 23 form a plurality of individual separate inflatable cushioning chambers 50. Chambers 50 remain uninflated and are either wound on roll R (FIG. 2) or folded up into stack S (FIG. 3) during storage.

A common collapsible inflation tool guideway 60 extends along cushioning system 10 in web direction W. Common inflation tool guideway 60 is in fluid communication with and perpendicular to each one way valve 23. Common inflation tool guideway 60 comprises upper and lower films 61, 62 located close together prior to the use of system 10 so as to make system 10 as flat as possible. Accordingly, films 61, 62 will need to be separated prior to use of system 10. Common inflation tool guideway may be perforated (not shown), fabricated of linear tear polyethylene or include peel seals (not shown) for use with multi-purpose tool 300 shown in FIG. 6.

Figure 5:
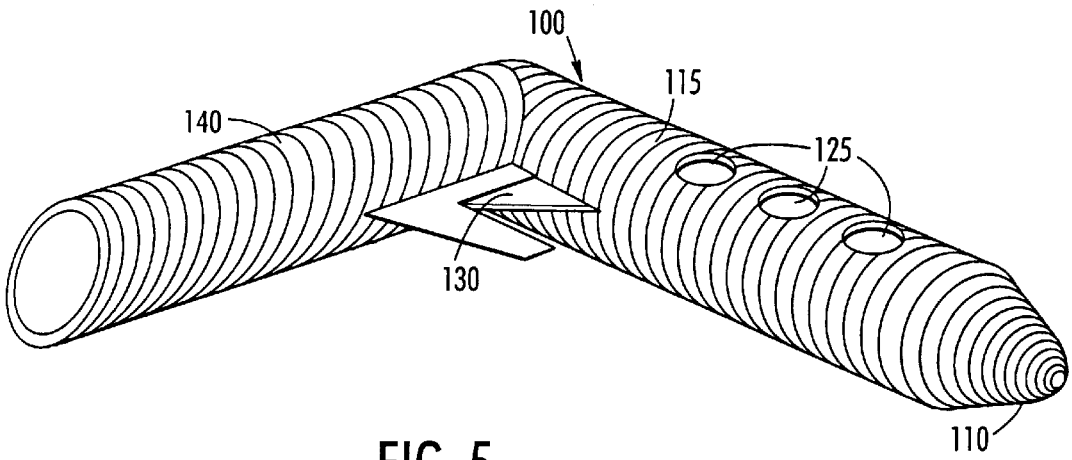
FIG. 5 is a perspective view of a multi-purpose inflation tool for use with the cushioning system according to the present invention.

The multi-purpose tool used to inflate individual cushioning chambers 50 will now be described with reference to FIGS. 5 and 6. FIG. 5 shows one embodiment of the device. The main body of tool 100 has a tapered closed first end 110 for spreading apart upper and lower films 61, 62 of common inflation tool guideway 60. Tapered end 110 leads to main hollow cylindrical portion 115 having bores 125 therein for the passage of pressurized air. Hollow portion 140 connects to a source of pressurized air (not shown). Pressurized air flows from the source; through the perpendicular hollow portion 140 and main hollow cylindrical portion 115; and finally exiting bores 125. The rear portion of hollow cylindrical portion 115 has a shielded blade 130 upstanding therefrom. Blade 130 is for slitting one of the upper or lower films 61, 62 as will be described below.

Figure 6:
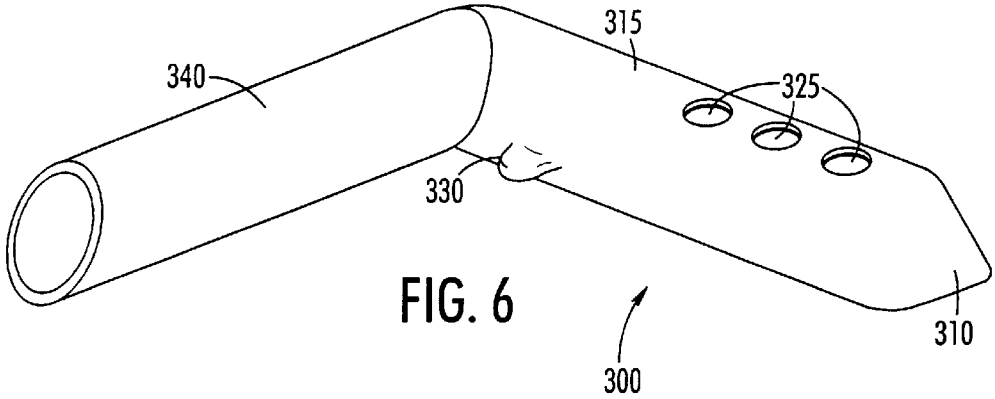
FIG. 6 is an alternate embodiment of the multi-purpose inflation tool for use with the cushioning system according to the present invention.

FIG. 6 shows a second embodiment of the device used to inflate individual cushioning chambers 50. Similar to the embodiment of FIG. 5, the main body of tool 300 has a tapered closed first end 310 for spreading apart upper and lower films 61, 62 of common inflation tool guideway 60. Tapered end 310 leads to main hollow cylindrical portion 315 having bores 325 herein for passage of pressurized air (not shown). Pressurized air follows from the source (not shown), through the perpendicular hollow portion 340, through main hollow cylindrical portion 315, and out bores 325. The rear portion of main hollow cylindrical portion 315 has a protrusion 330 extending therefrom. Protrusion 330 is for breaking open a wall of common inflation tool guideway 60. Protrusion 330 can break open and separate a wall of inflation tool guideway 60 at a perforation (not shown) or the peel seal (not shown). Further, the common inflation tool guideway 60 could be fabricated from linear tear polyethylene that is designed to fracture in web direction W.

The preferred method of inflating the individual cushioning chambers 50 will now be described. Although described in terms of the multi-purpose tool 100, multi-purpose tool 300 can also be utilized. Tapered closed first end 110 of tool 100 is placed into the inflation tool guideway 60 at its opening by first manually separating upper and lower films 61, 62. The inside dimension of common inflation tool guideway 60 closely corresponds to the circumference of the hollow cylindrical portion 115 of tool 100 so as to restrict the unwanted escape of air. Main hollow cylindrical portion 115 is inserted to a point before which blade 130 contacts films 61, 62. Preferably, the length of main hollow cylindrical portion 115 is approximately the span of three individual cushioning chambers 50. Bores 125 are positioned on hollow cylindrical portion 115 adjacent and lined-up with one-way valves 23 at each individual cushioning chamber 50. In an alternate embodiment of multi-purpose tool 100 (not shown) the hollow cylindrical portion 115 may be constructed in part of screen (not shown) or mesh material (not shown) thereby eliminating the need for bores 125 and achieving multidirectional flow characteristics.

Pressurized air is injected through the open end of perpendicular hollow portion 140. The pressured air passes into main hollow cylindrical portion 115, out of bores 125, and towards the ports that connect to one way valves 23. The tight fit between main hollow cylindrical portion 115 and common inflation tool guideway 60 assures that an excess amount of pressurized air is not lost. Pressurized air emitted from bores 125 opens one way valves 23 and enters the individual inflatable cushioning chambers 50.

The flow of pressurized air into the chambers 50 stops when the internal pressure rises to a level proportionate to that of the source air supply pressure. When the supply of pressurized air from multi purpose tool 100 is removed or discontinued, one-way check valves 23 close to maintain the pressurized air within the individual inflatable cushioning chambers 50.

Tool 100 is further advanced along common inflation tool guideway 60 so as to place its bores 125 in line with one way valves 23 corresponding to the next set of individual air chambers 50. The continued sliding advancement of tool 100 along common inflation tool guideway 60 is possible due to the operation of blade 130. Blade 130 slices either the upper or lower film 61, 62. This allows the continued movement of tool 100 along the length of system 10 in web direction W without slicing the entire cushioning systems 10 in half. If blade 130 was not present, the perpendicular hollow portion 140 and connected air supply tube (not shown) of tool 100 would prohibit further advancement of tool 100 along common inflation tool guideway 60.

The use of tool 300 is the same as the method described above with respect to tool 100, except for the operation of blade 130. Instead, further insertion of tool 300 is possible due to the operation of protrusion 330. Protrusion 330 ruptures the common inflation tool guideway. Protrusion 330 can split one of the films of common inflation tool guideway at a perforation (225) or a peel seal (not shown). Also, upper or lower film 61, 62 of common inflation tool guideway 60 could be fabricated from linear tear polyethylene. Forward movement of protrusion 330 along the common inflation tool guideway 60 perpetuates the splitting of upper or lower film 61, 62.

Multipurpose inflation tool 100, 300 can have a variety of shapes without departing from the scope of the invention. For example, the tool may lack the L-shape of tools 100, 300 (not shown) or may be constructed with alternative cross-sectional shapes such as an oval (not shown).

Figure 12:
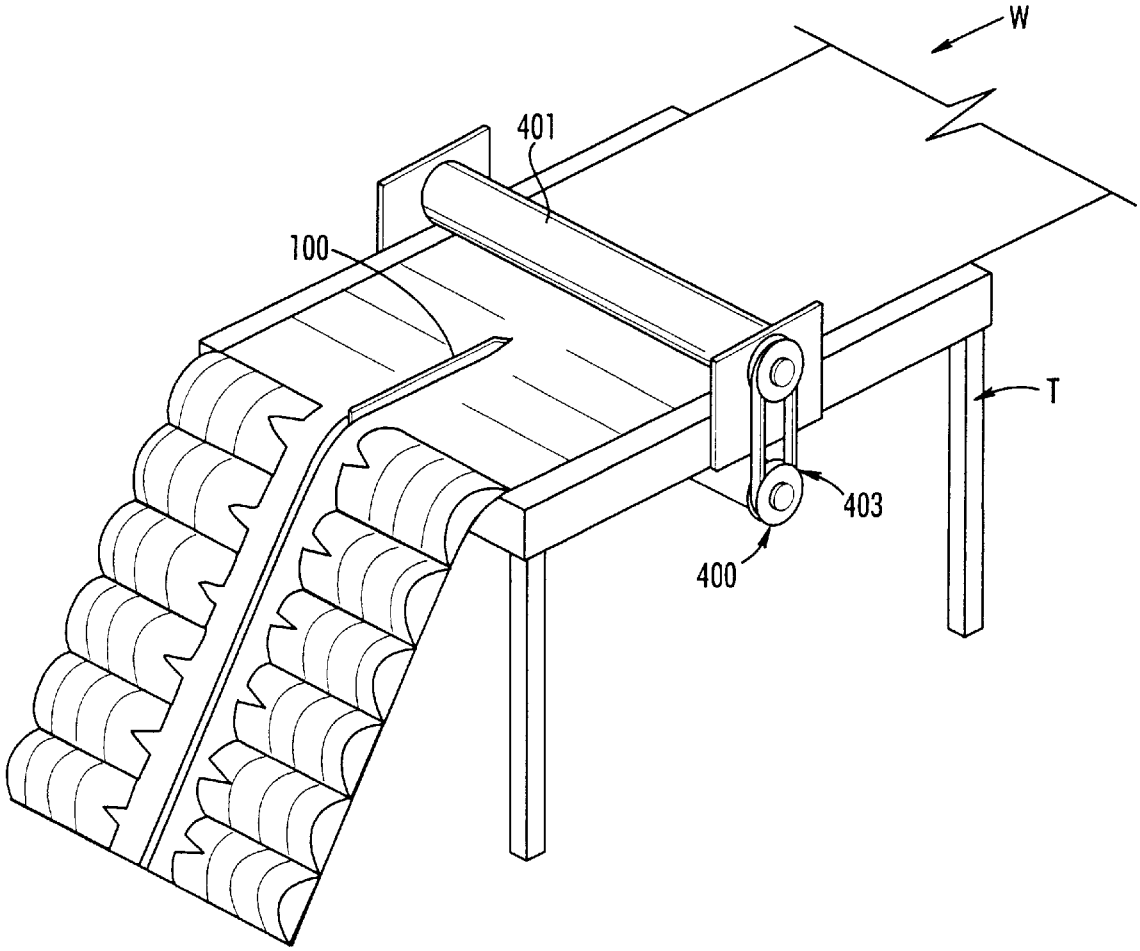
FIG. 12 is a perspective view of a semi automated assembly for inflating the cushioning system.

The inflation process using the multipurpose tools can be fully automated, or at least may provide mechanical assistance to the deployment process. FIG. 12 shows the inflation of air cushioning system 10 using automated means. In particular, tool 100 may be mounted to a worktable T and provided with a means 400 for automatically feeding air cushioning 10 towards tool 100. As shown in FIG. 12, automatic feeding means 400 includes a central feed roller 401 and a transmission 403 for driving feed roller 401. Feed roller 401 draws cushioning system 10 in web direction W toward tool 100. Feed roller 401 may be intermittent or continuous in motion and set at such a rate that provides for complete filling of the individual inflatable cushioning chambers 50. Automatic feeding means 400 may comprise any of the known devices for the controlled movement of a sheet product along a given path.

The preferred method of constructing inflatable cushioning system 10 will be described with reference to FIGS. 7–11. Briefly, inflatable cushioning system 10 is formed through the merger of two sets of superimposed film webs. The first set of film webs comprise lower valve web 200 and upper valve web 220. Webs 200, 220 are preferably a heat sealable 3 to 5 layer co-extrusion with a thickness in the range of approximately 1.0 to 4.0 mils. The upper and lower valve webs are joined to form a continuous valve assembly 240. The second set of films webs comprise webs 245, 246. Webs 245, 246 are preferably a blown polyethylene coextruded film with a 5–30% nylon content, total thickness in the range of 0.015 to 0.006 inches, and at least one outer film surface of heat sealable polyethylene. Valve assembly 240 is sandwiched between the second set of webs 245, 246. Webs 245,246 comprise walls 25, 27 of inflatable cushioning system 10. Heat seals 20, 21 and 22 converge the plurality of webs into a unitary and continuous web structure.

Figure 9:
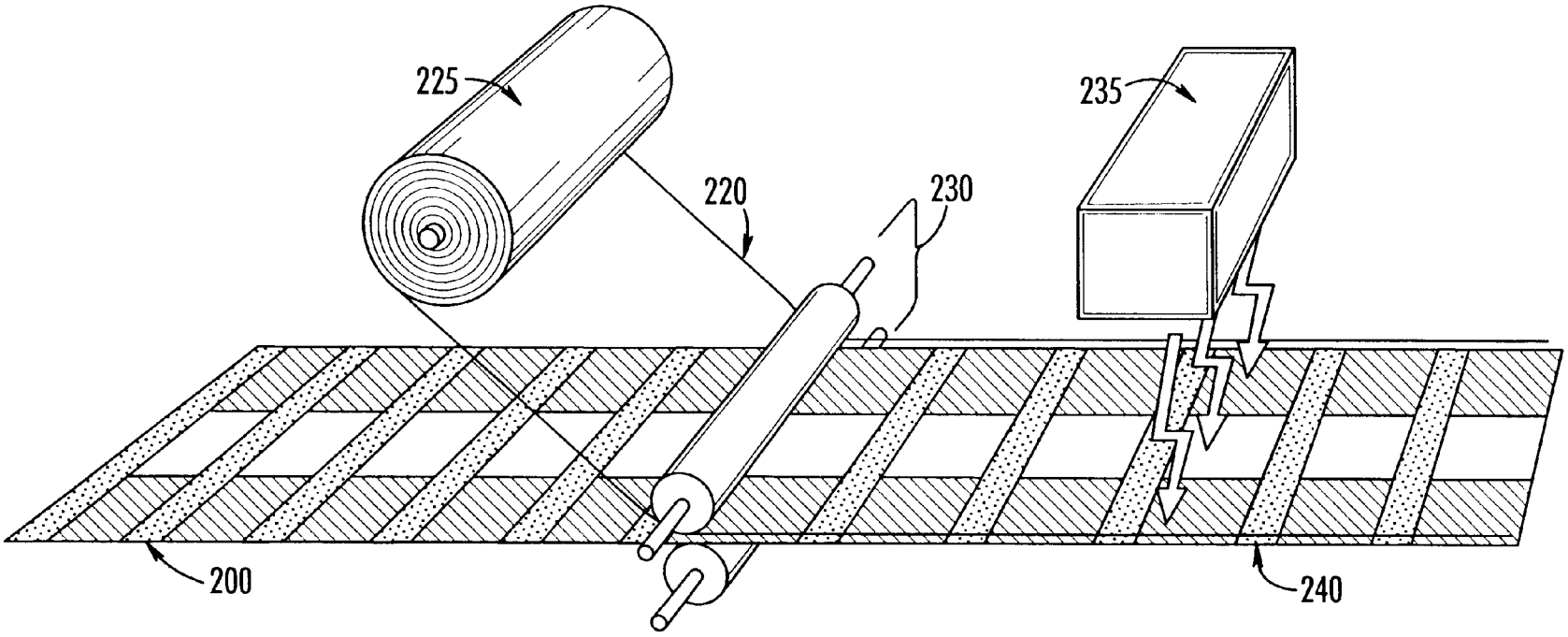
FIG. 9 is a perspective view of another step of the valve assembly manufacture.

FIGS. 7–9 show the steps of constructing valve assembly 240. As shown in FIG. 7, a zone coating 210 is printed on the upper side of the lower valve web 200. Zone coating 210 is preferably a non-migratory formula containing a surfactant agent, light grease or humectant. Alternately, the coating may be an ultraviolet curable heat resistant acrylate. The zone coating 210 is then dried or cured as required before subsequent processing. The zone coating 210 serves to ensure an air tight seal between the upper surface of lower valve web 200 and lower surface of valve web 220 following the inflation process. A secondary function of zone coating 210 is to prevent the sealing of valve passage 23 during the later phases of manufacture.

FIG. 8 shows another step in the manufacture of valve assembly 240. A wet adhesive film is applied to the upper side of lower valve web 200 in zones 215. Wet adhesive film 217 (not shown) is preferably an ultraviolet radiation cured 100% solids system. Applicant contemplates the use of other adhesives, such as rubber-based adhesives, acrylics and hot melts.

FIG. 9 shows another step in the manufacture of valve assembly 240. Nip rollers 230 join the upper sides of valve web 200 with the lower side of valve web 220. The joined webs are passed through an ultraviolet energy source 235 for curing and setting adhesive film 217 in zones 215. Zones 215 produce a permanent adhesive seal between webs 200, 220. An adhesive seal is not produced in the areas which lack adhesive film 217. The adhesive juncture of valve web 200 and valve web 220 define the two dimensional areas of common inflation guideway 60, and valve passages 23. The areas which lack adhesive coating 217 include: (1) areas that have zone coating 210; and (2) all other areas that lack both zone coating 210 and adhesive film 217. The completed valve assembly 240 is a planar, continuous two-ply web with a common inflation tool guideway 60 and valve passages 23 extending perpendicularly from both sides of common inflation tool guideway 60. Although valve passages 23 are shown to be straight sided and parallel, applicant contemplates that the use of other one way valve designs known to those skilled in the art are possible without departing from the purpose and spirit of the invention.

Valve passages 23 operate as follows. Prior to inflation, valve passages 23 have a two-dimensional, planar form. A non-distorted planar form is ensured by the use of adhesive film 217 and nip rollers 230 during assembly of valve assembly 240. Opposing webs 200, 220 in the area of valve passage 23, with the aid of Zone Coating surfactant 210, create an airtight seal.

During inflation, air pressure applied causes webs 200, 220 to separate and form a three-dimensional passage. The passage is formed by upper web 220, lower web 200 and adhesive seals 215. When the supply of pressurized air is shut off, valve passages 23 return to their normalized, planar state.

Applicant contemplates different embodiments of valve assembly 240 and the construction thereof. The valve assembly web could be constructed with the valve passages extending from only one side of the inflation air inlet (not shown). In this embodiment, the upper and lower valve webs may be formed from a single web, folded upon itself. The valve assembly could also be constructed by heat sealing the webs to define the valve passages 23, rather than using adhesive and ultraviolet curing. The webs could also be made from materials that make the need for zone coating unnecessary. For example, the webs may be constructed of a lamination of corona treated polyester and polyethylene. The adhesive film is applied to the polyester surface of web 200 and joined with the opposing polyester surface of web 220. The high energy polyester surfaces have auto adhesion properties that help to prevent the escape of air.

Figure 10:
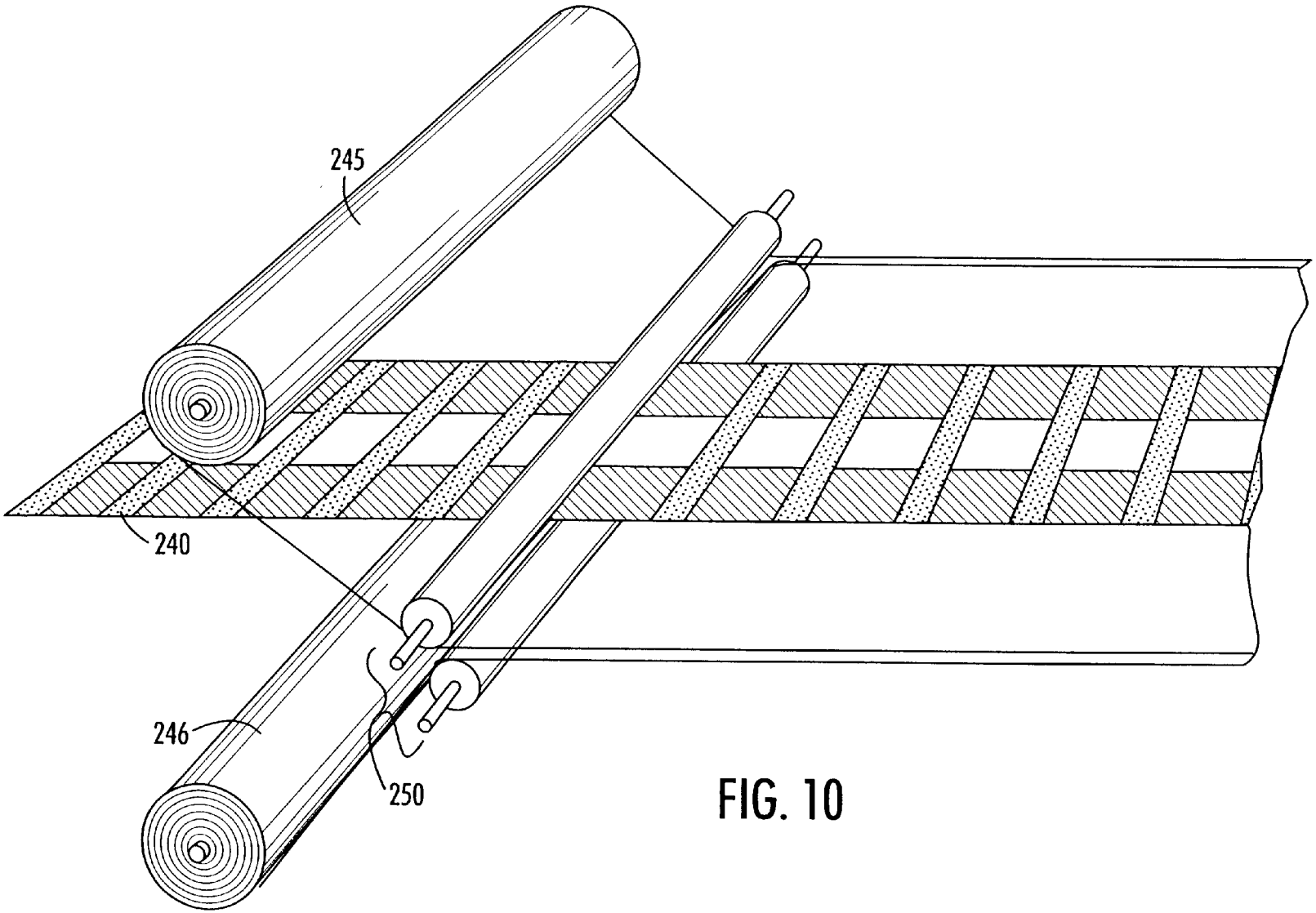
FIG. 10 is a perspective view of a step in the manufacture of the inflatable cushioning system exemplified by FIG. 1.
Figure 11:
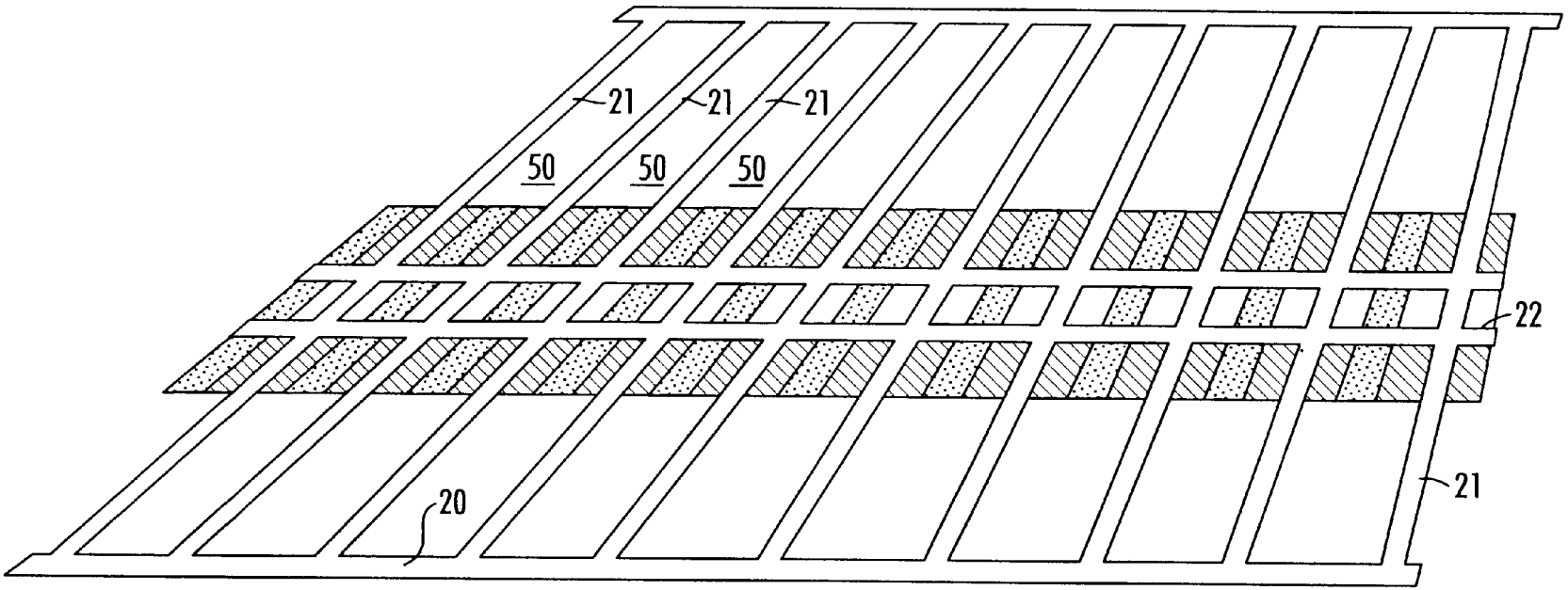
FIG. 11 is a perspective view of the heat sealing step in the manufacture of the inflatable cushioning system exemplified by FIG. 1.

FIGS. 10 and 11 demonstrate the final steps of constructing inflatable cushioning system 10. As shown in FIG. 10, completed valve assembly 240 is sandwiched between webs 245 and 246. Webs 240, 245, 246 then pass through rollers 250 to remove any air lodged therebetween.

FIG. 11 shows the location of heat seals 20, 21, 22 on webs 240, 245, 246 after using a conventional sealer. Webs 240, 245, 246 are heat sealed after passing through rollers 250 shown in FIG. 10. Heat seals 20, 21, 22 fix valve assembly 240 in position and form individual inflation chambers 50. Primary heat seals 20 run parallel to web direction W and along the edges of webs 245, 246. Secondary heat seals 21 run perpendicular to web direction W and between primary seals 20. Heat seals 22 parallel primary heat seals 20 and intersect secondary heat seals 21. Hermetic juncture of webs 200, 220, 245 246 along the parallel sides of common inflation guideway 60 is completed by heat seals 21, except between webs 200, 220 in the area of zone 210. Therefore, valves 23 remain open in valve assembly 240 to allow air to pass therethrough.

Parallel seals 22 may further define the dimensions of common inflation tool guideway 60. Alternately, webs 245, 246 need not overlap web 240 in the area of common inflation guideway 60 (not shown).

Inflatable cushioning system 10 has been described herein as using air as the inflation medium. Applicant contemplates the use of any suitable fluid as the inflation medium to achieve similar results.

Applicant also recognizes other numerous variations from the embodiments described herein. These variations are apparent to one of ordinary skill in the art from reading of the disclosure of the invention. Such variations and modifications apparent to those skilled in the art are within the scope and spirit of the instant invention as defined by the following appended claims.

I claim:

1. A method for charging an inflatable cushion systems, said system having a plurality of inflatable chambers having one-way inflation valves aligned in rows along a common tool guideway, said method comprising:

inserting into said common tool guideway a tool comprising:

1) a main hollow body having an axis, a tapered closed first end and a plurality of paired openings spaced in the direction of the axis at a distance corresponding to the spacing of said chambers;

2) a second body portion attached to said main hollow body at an angle to said first axis and having a longitudinal opening communicating with said hollow portion of said main hollow body;

introducing a fluid through said second body portion and through said main hollow body into said inflatable chambers; and separating said rows of inflatable chambers along said common tool guideway to advance said tool along said plurality of inflatable chambers.

2. A method according to claim 1 wherein said fluid is gas.

3. A method according to claim 1 wherein said gas is air.

4. A method according to claim 1 wherein said introducing of said fluid is continuous.

5. A method according to claim 1 wherein said introducing of said fluid is in pulses.

6. A multi-purpose tool for inflating an inflatable cushion system, said system having a) a plurality of inflatable chambers having one-way inflation valves and b) a common tool guideway between paired rows of chambers, said tool comprising:

1) a main hollow body having an axis, a tapered closed first end and a plurality of paired openings spaced in the direction of the axis a distance corresponding to the spacing of said chambers;

2) a second body portion attached to said main hollow body at an angle to said first axis and having a longitudinal opening communicating with said hollow portion of said main hollow body; and 3) means for separating said common tool guideway after said chambers have been inflated.

7. A multi-purpose tool according to claim 6 wherein said means for separating constitutes a knife blade mounted at a juncture of said main body portion and said second body portion.

8. A multi-purpose tool according to claim 6 wherein said means for separating constitutes a protrusion from said main hollow body between a juncture of said main body and second portion and a first pair of openings.

9. A multi-purpose tool according to claim 6 wherein said main hollow body is cylindrical.

10. A multi-purpose tool according to claim 6 wherein said main hollow body is oval.

11. A multi-purpose tool according to claim 6 wherein said plurality of paired openings are elongated and bridge two or more of said chambers.

* * * * *